United States Patent [19]

Nakamura et al.

[11] 4,056,932

[45] Nov. 8, 1977

[54] CONTROL SYSTEM FOR PROMOTING CATALYTIC REMOVAL OF NOXIOUS COMPONENTS FROM EXHAUST GAS OF INTERNAL COMBUSTION ENGINE

[75] Inventors: Koyo Nakamura, Yokosuka; Hiroshi Sanbuichi, Yokohama, both of Japan

[73] Assignee: Nissan Motor Co., Ltd., Japan

[21] Appl. No.: 627,334

[22] Filed: Oct. 30, 1975

[30] Foreign Application Priority Data

Nov. 1, 1974 Japan ..... 49-132670[U]
Nov. 12, 1974 Japan ..... 49-129583

[51] Int. Cl.[2] ..... F02D 33/00; F02D 35/00

[52] U.S. Cl. ..... 60/276; 123/119 R; 123/119 D; 261/121 B

[58] Field of Search ..... 123/119 D, 119 R; 60/276; 261/DIG. 74, 121 B, 121 A; 251/141

[56] References Cited

U.S. PATENT DOCUMENTS

| | | | |
|---|---|---|---|
| 2,939,673 | 6/1960 | Rosholt | 251/141 X |
| 3,693,947 | 9/1972 | Masaki | 261/121 A |
| 3,765,387 | 10/1973 | Knapp | 123/119 R |
| 3,861,366 | 4/1973 | Masaki | 123/119 R |
| 3,921,612 | 11/1975 | Aono | 123/119 R |
| 3,942,493 | 3/1976 | Linder | 123/119 D |
| 3,963,009 | 6/1976 | Mennesson | 123/119 D |

*Primary Examiner*—Robert G. Nilson
*Attorney, Agent, or Firm*—Robert E. Burns; Emmanuel J. Lobato; Bruce L. Adams

[57] ABSTRACT

With respect to an internal combustion engine equipped with a carburetor and a catalytic converter which requires to feed the engine with a stoichiometric air/fuel mixture, the control system is for regulating the air/fuel ratio produced in the carburetor and comprises an auxiliary air admitting passage connected to the fuel discharge passage of the carburetor in addition to a usual air bleed passage for the fuel discharge passage, an electromagnetic valve for controlling the admission of air into the auxiliary passage, an oxygen sensor disposed in the exhaust system upstream of the catalytic converter, and a control circuit for producing continual pulses at a frequency between 5 and 100 Hz. The widths of the individual pulses are increased gradually while the output of the oxygen sensor indicates the air/fuel ratio being below the stoichiometric ratio, and vice versa. The valve is opened as each pulse is applied thereto so that the air feed rate to the fuel in the fuel passage is momentarily augmented by admission of air into the auxiliary passage.

32 Claims, 14 Drawing Figures

CONTROL SYSTEM FOR PROMOTING CATALYTIC REMOVAL OF NOXIOUS COMPONENTS FROM EXHAUST GAS OF INTERNAL COMBUSTION ENGINE

BACKGROUND OF THE INVENTION

This invention relates to a system for promoting removal of noxious components from the exhaust gas of an internal combustion engine which is equipped with a carburetor and in its exhaust line a catalytic converter.

With respect to an internal combustion engine, it is one of the fundamental requisites to success in removing, or at least reducing for the most part, noxious components from the exhaust gas that the air-fuel ratio of a combustible mixture fed to the engine is maintained at a predetermined value with high precision. This requisite is critical when removal of the noxious components is accomplished by catalytic conversion in the exhaust system of the engine.

There has been proposed an excellent catalyst which comprises a plurality of platinum group metals and catalyzes both the oxidation of carbon monoxide and unburned hydrocarbons and the reduction of oxides of nitrogen. This catalyst exhibits its full ability in the exhaust gas from a conventional gasoline engine only when the engine is run with an air/fuel mixture prepared at approximately, if not exactly, the stoichiometric mixing ratio. When the air-fuel ratio of the mixture exceeds the stoichiometric ratio (about 14.8 by weight for air/gasoline mixture), a sharp drop occurs in the conversion efficiency of removing oxides of nitrogen. On the other hand, the efficiency of oxidizing carbon monoxide and unburned hydrocarbons drops sharply when the air-fuel ratio is lowered from the stoichiometric ratio. It is necessary, therefore, to maintain the air/fuel ratio of the combustible mixture at the stoichiometric ratio with accuracy of better than $\pm 1\%$. It was impossible, however, with conventional carburetors to accomplish such a precise control of the air/fuel ratio since the air/fuel ratio depends on physical properties such as density and viscosity of air and fuel which are variables depending on the atmospheric pressure, ambient temperature, and fuel temperature.

In connection with control of the air/fuel ratio, it is known that an actual air/fuel ratio in the running engine can be estimated by measuring the concentration of a certain component of the exhaust gas by the use of an electrical sensor. Useful sensors are known for almost every of major components of the exhaust gas such as oxygen, carbon monoxide, carbon dioxide, hydrocarbons and oxides of nitrogen. For example, an oxygen sensor of the concentration cell type having an ion-conducting solid electrolyte is particularly suitable for detecting slight deviations of the air/fuel ratio from the stoichiometric ratio because the relationship between the output voltage of this sensor exposed to the exhaust gas and the air/fuel ratio of the combustible mixture fed to the engine exhibits a very sharp and great change at the stoichiometric air/fuel ratio.

With respect to an internal combustion engine which is equipped with a carburetor having an air bleed passage opening into a fuel discharge passage and, in the exhaust system, a catalytic converter containing therein a catalyst which catalyzes oxidation of carbon monoxide and hydrocarbons and reduction of oxides of nitrogen, it is an object of the present invention to provide a system for promoting removal of noxious components from the exhaust gas, which system controls the air/fuel ratio of the combustible mixture fed to the engine to the stoichiometric ratio with high precision based on the concentration of a particular component of the exhaust gas measured in the exhaust system at a location upstream of the catalytic converter.

SUMMARY OF THE INVENTION

A system according to the invention comprises:

A system according to the invention comprises: an auxiliary air admitting passage connected to a fuel discharge passage of the carburetor; a sensor which is disposed in the exhaust system at a location upstream of the catalytic converter and produces an electrical signal representing the concentration of a particular component of the exhaust gas having dependence on the air/fuel ratio of the air/fuel mixture fed to the engine; a control circuit which produces continual pulses of a variable width at a frequency between 5 and 100 Hz in response to the signal from the sensor; and an electromagnetic valve arranged to cause admission of auxiliary air to the auxiliary air admitting passage only when the individual pulses are applied thereto. The width of the pulses is increased individually when the air/fuel ratio indicated by the signal from the sensor is below a predetermined ratio which is equal to or close to the stoichiometric ratio and decreased individually when the indicated air/fuel ratio is above the predetermined ratio, so that the fuel discharge rate to the induction passage of the carburetor is varied in response to deviations of the indicated air/fuel ratio from the predetermined ratio.

The auxiliary air admitting passage is preferably connected to the air bleed passage at a section downstream of the orifice of the air bleed passage and has preferably such a cross-sectional area at the narrowest section that the air feed rate therethrough when the valve causes the admission of auxiliary air takes a value 1 to 5 times as large as the air feed rate through the air bleed passage.

Another auxiliary air admitting passage under a similar control of a similar electromagnetic valve is preferably provided to a slow-speed fuel discharge passage of the carburetor.

BRIEF DESCRIPTION OF THE DRAWINGS

Other objects, features and advantages of the invention will become apparent from the following detailed description of preferred embodiments thereof with reference to the accompanying drawings, wherein.

DESCRIPTION OF THE PREFERRED EMBODIMENTS

Figure 1:
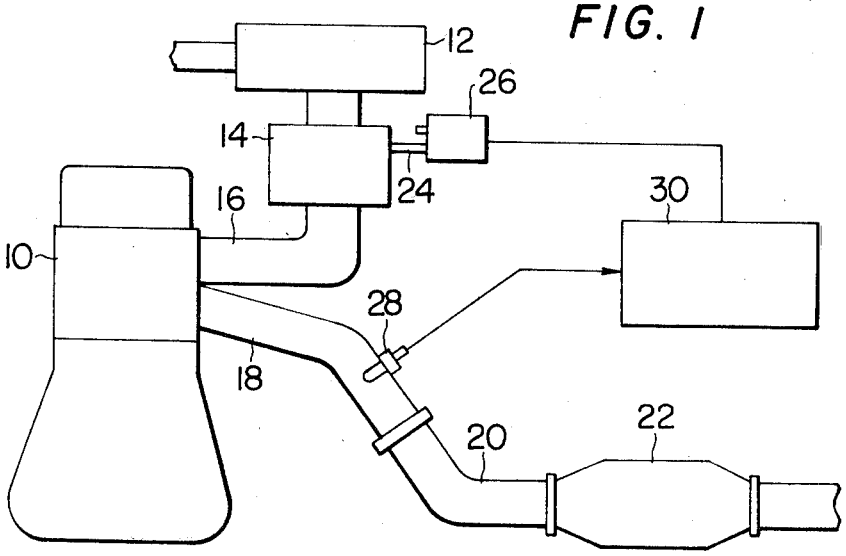
FIG. 1 is a diagram showing the fundamental constitution of a system according to the invention.

Referring to FIG. 1, an internal combustion engine 10 is equipped with an air cleaner 12 and a carburetor 14 in combination with its induction passage 16 and, as the exhaust system, an exhaust manifold 18, an exhaust pipe 20 and a catalytic converter 22 which is arranged to occupy an intermediate section of the exhaust pipe 20. The catalytic converter 22 contains therein a conventional catalyst which catalyzes oxidation of carbon monoxide and hydrocarbons and reduction of oxides of nitrogen. When this catalyst is exposed to the exhaust gas containing oxygen, carbon monoxide, unburned hydrocarbons and oxides of nitrogen, the efficiencies in the catalytic actions of the catalyst on these oxidation and reduction reactions depend greatly on the composition of the exhaust gas and, hence, air/fuel ratio of the air/fuel mixture fed to the engine 10.

To the carburetor 14, an auxiliary air admitting passage 24 is provided for admitting air into a fuel discharge passage (not shown) in a manner as will be described hereinafter, and an on-off functioning electromagnetic valve 26 is arranged to control the admission of air into this air admitting passage 24. An exhaust sensor 28 is installed in the exhaust system at a section upstream of the catalytic converter 22, for example, in the exhaust manifold 18. A control circuit 30 receives an electrical signal from the sensor 28 and produces an output for operating the electromagnetic valve 26 in compliance with the amplitude of the signal from the sensor 28.

Figure 3:
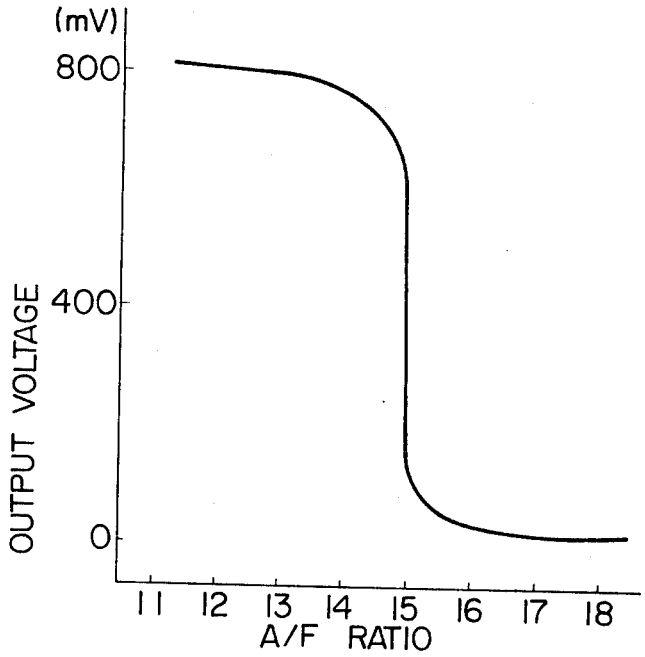
FIG. 3 is a graph showing the relationship between the air/fuel ratio of air/gasoline mixture fed to an internal combustion engine and the output voltage of an oxygen sensor exposed to the exhaust gas of the engine.

The exhaust sensor 28 is preferably an oxygen sensor of the well known concentration cell type having an ion-conducting solid electrolyte exemplified by stabilized zirconia ($ZrO_2$—CaO). The graph of FIG. 3 shows a typical relationship between the air/fuel ratio (by weight) of air/gasoline mixture fed to the engine 10 and the output voltage of the sensor 28 of this type when the sensor 28 is exposed to the exhaust gas of the engine 10. The oxygen sensor 28 may be replaced by any known sensor of a different type which is sensitive to a particular substance contained in the exhaust gas in a variable concentration depending on the air/fuel ratio of the air/fuel mixture fed to the engine 10, for example, carbon monoxide sensor, carbon dioxide sensor, hydrocarbon sensor or nitrogen oxide sensor.

As is known, the air/fuel ratio of the combustible mixture prepared in the carburetor 14 can be varied by controlling the discharge rate of the fuel from the main nozzle and accordingly can be controlled by controlling the feed rate of air to the fuel in the main fuel discharge passage. The auxiliary air admitting passage 24 in a system of FIG. 1 is provided for the accomplishment of an air/fuel ratio control in such a manner.

Figure 2:
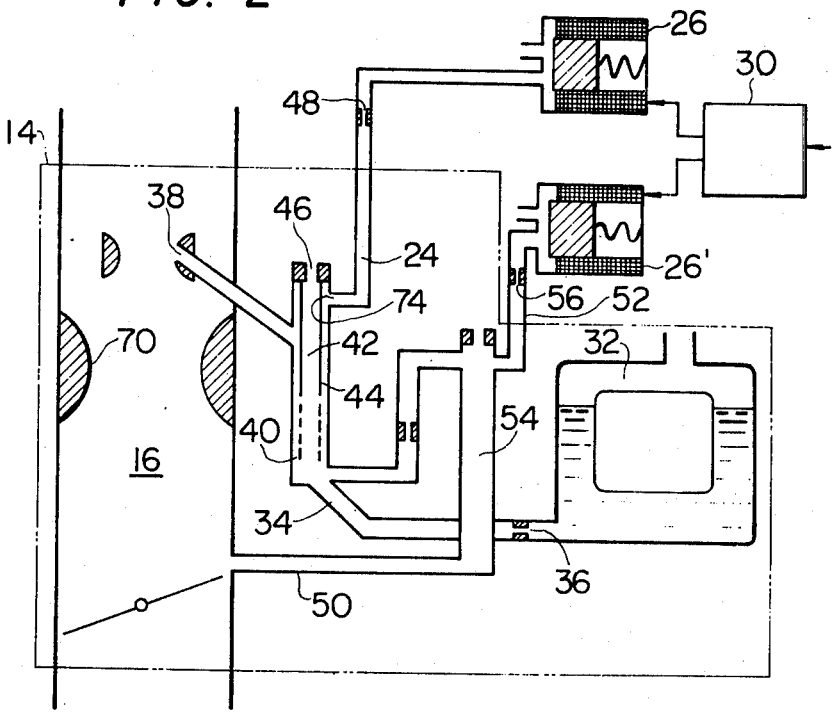
FIG. 2 is a diagram showing more in detail a portion of the same system in association with a carburetor.

Referring to FIG. 2, the carburetor 14 has a float chamber 32 and a main fuel discharge passage 34 which is formed between a main fuel jet 36 and a main nozzle 38. As usual, an intermediate section of the main fuel passage 34 forms a main well 40, and a main air bleed passage 42 is provided to the main well 40 in the form of a perforated tube 44 having a main air bleed orifice 46 at its exposed end.

The auxiliary air admitting passage 24 is arranged such that auxiliary air is supplied to the fuel in the main well 40 in addition to usual air supply through the main air bleed passage 42. Alternatively, the auxiliary air admitting passage 24 may be connected to the main fuel discharge passage 34 at a section upstream of the main well 40. It has been proposed to control the fuel discharge rate from the nozzle 38 by intermittently interrupting the admission of air through the air bleed orifice 46. When, however, the air feed rate to the fuel is controlled in such a manner, there will arise unfavorable problems such as irregular shifts of the fundamental setting of the carburetor 14 and/or a significant hunting in the fuel discharge rate. The auxiliary air admitting passage 24 is provided to preclude such problems and control the fuel discharge rate smoothly and accurately.

The auxiliary air admitting passage 24 is preferably arranged to open into the main well 40 at a section above the fuel level therein. When the auxiliary air admitting passage 24 is connected to the fuel discharge passage 34 at a section upstream of the main well 40, it is rather difficult to control the air/fuel ratio precisely because blowing of air (gas) into the fuel (liquid) causes turbulence and even pulsation of the fuel flow by reason of the electromagnetic valve 26 being of the on-off functioning type. The arrangement of the auxiliary air admitting passage 24 will be described hereinafter more in detail.

The electromagnetic valve 26 interrupts completely the admission of air from the atmosphere into the auxiliary air admitting passage 24 through its metering orifice 48 when the valve 26 is in the off-state or closed state. In this state, the air feed rate to the fuel in the main fuel passage 34 is dependent solely on the air velocity at the main air bleed 46. When the valve 26 is opened, the fuel discharge rate lowers since the air feed rate to the fuel in the fuel passage 34 is augmented by the opening of the auxiliary air admitting passage 34.

Figure 7:
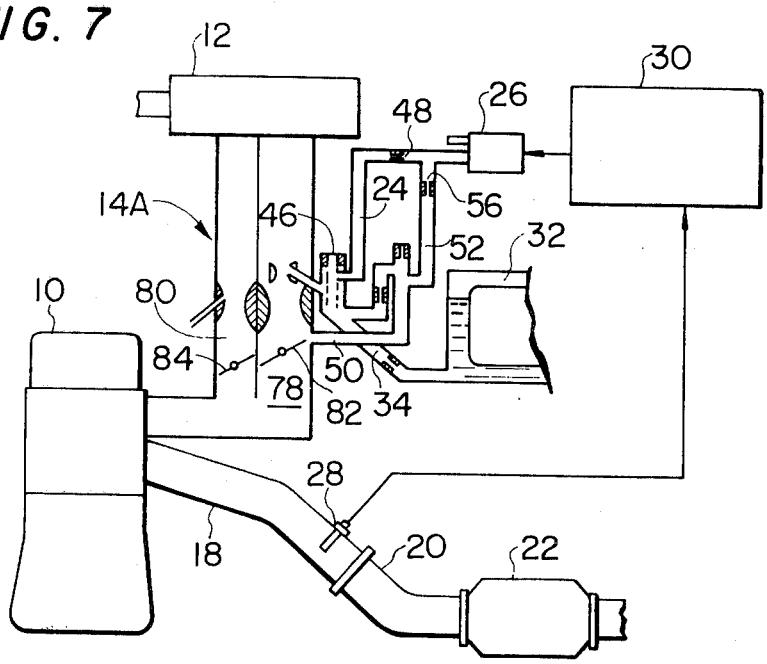
FIG. 7 is a diagram fundamentally similar to FIG. 2 but with a carburetor of the two-barrel, two-stage type.

Preferably, the fuel discharge rate through a slow-speed fuel passage 50 of the carburetor 14 also is controlled by the provision of another auxiliary air admitting passage 52 other than a usual air bleed passage 54. The auxiliary air admitting passage 52 is arranged generally as described hereinbefore and will be described hereinafter with respect to the auxiliary air admitting passage 24 for the main fuel discharge passage 34. The admission of air into the auxiliary air admitting passage 52 for the slow-speed circuit is controlled by another set of electromagnetic valve 26′ which is separate from but identical with the valve 26 for the main fuel circuit. Alternatively, the auxiliary air passage 52 for the slow-speed circuit is arranged to join the auxiliary air admitting passage 24 for the main circuit at a section upstream of the respective metering orifices 48 and 56, so that the admission of air into both of the two passages 24 and 52 can be controlled by a single electromagnetic valve 26 as shown in FIG. 7 (FIG. 7 shows a carburetor 14A of the two-barrel type as will hereinafter be described, but the difference in the type of carburetor 14 will not obstruct the understanding of the above described simultaneous control of the two air admitting passages 24 and 52).

Figure 4:
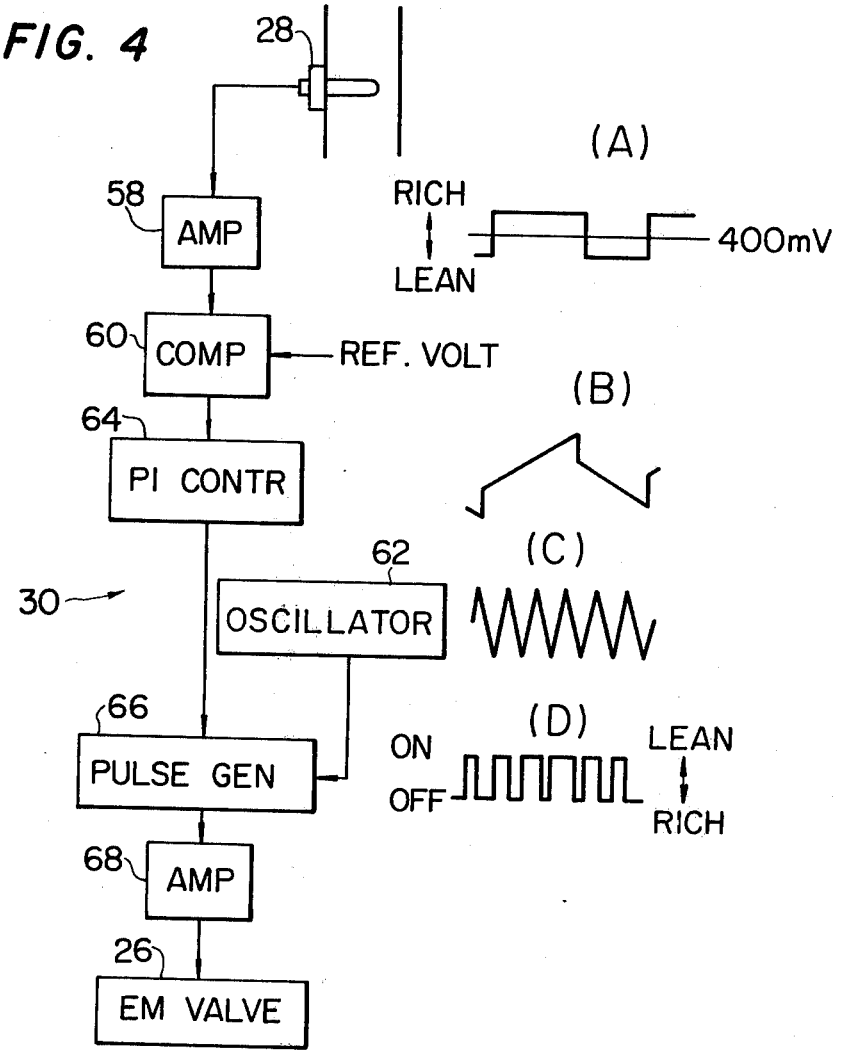
FIG. 4 is a block diagram of the control circuit in the system of FIG. 1.

Referring to FIG. 4, the control circuit 30 for operating the electromagnetic valve 26 includes an amplifier 58 for the amplification of the output of the oxygen sensor 28, a comparator 60 for comparing the amplified output with a reference voltage, an oscillator 62 which oroduces a triangular wave of a predetermined frequency, a PI(proportional and integral) control amplifier 64 for modulating the output of the comparator 60, and a pulse generator 66 which produces rectangular pulses at the same frequency as the triangular wave. The widths of the individual pulses are varied depending on the amplitude and waveform of the output of the PI control amplifier 64. The pulses are supplied to the electromagnetic valve 26 through an amplifier 68.

In operation, the output voltage of the oxygen sensor 28 in the exhaust manifold 18 varies as shown in FIG. 3 if changes occur in the air/fuel ratio of the air/gasoline mixture supplied from the carburetor 14 to the engine 10. There is a sharp difference between the level of the output voltage of the oxygen sensor 28 at air/fuel ratios below the stoichiometric air/fuel ratio, i.e., approximately 14.8, and another level at air/fuel ratios above the stoichiometric ratio. Accordingly, it can easily and exactly be judged whether an actual air/fuel ratio produced in the carburetor 14 is below or above the stoichiometric ratio by the comparison of the output voltage of the oxygen sensor 28 with a reference voltage, e.g., of 400 mV. in the comparator 60. When the output voltage of the oxygen sensor 28 is above 400mV indicating that the actual air/fuel ratio is below 14.8, the output of the PI control amplifier 64 continues to increase its amplitude as schematically represented at (B) in FIG. 4 in comparison with a schematic representation of the waveform of the output of the oxygen sensor 28 at (A). Although the oscillator 62 produces a continual and constant triangular wave usually at a fixed frequency as represented at (C), the widths of the individual pulses from the pulse generator 66 are variably increased as seen at (D) when the output of the PI control amplifier 64 continues to increase its amplitude. The electromagnetic valve 26 is opened to expose the orifice 48 of the auxiliary air admitting passage 24 to the atmosphere when each of these pulses are applied thereto through the amplifier 68. The increases in the widths of the individual pulses at a fixed frequency result in shortenings of the intervals between the pulses, that is, shortenings of time periods during which the electromagnetic valve 26 is kept closed.

Thus, admission of air into the fuel in the fuel discharge passage 34 is augmented by the feed of auxiliary air through the auxiliary air admitting passage 24, so that the fuel discharge rate from the main nozzle 38 is lowered until the output of the oxygen sensor 28 shifts to the lower level below 400 mV indicating that the actual air/fuel ratio exceeds 14.8. Then the amplitude of the output of the PI control amplifier 64 lowers by a value corresponding to the change in the output voltage of the oxygen sensor 28 and continues to decrease while the output voltage of the oxygen sensor 28 is below 400 mV. In this state, the pulse generator 66 functions to decrease the duration or width of each pulse more and more. Accordingly, the air feed rate through the auxiliary air admitting passage 24 is lowered gradually, and the fuel discharge rate from the main nozzle 38 is increased gradually until the air/fuel ratio becomes below 14.8.

A system according to the invention controls the fuel discharge rate into the induction passage 16 of the carburetor 14 intermittently by varying the proportion of a total duration of the auxiliary air admission into the fuel through the auxiliary air admitting passage 24 in a unit time. The fuel discharge rate into the induction passage 16 at almost every moment is deviated from, i.e., either above or below, a rate appropriate for producing a predetermined air/fuel ratio which equals to or close to the stoichiometric ratio. The excess and lack of the discharged fuel relative to the air admission rate into the induction passage 16, however, can be averaged to a fuel discharge rate practically just appropriate for producing the predetermined air/fuel ratio before the air/fuel mixture is fed to the engine 10 by proper determination of the area of the metering orifice 48 of the auxiliary air admitting passage 24 and the widths of and intervals between the individual pulses supplied to the valve 26.

The frequency of the pulses supplied from the control circuit 30 to the electromagnetic valve 26 would be as high as possible in principle to accomplish a precise control of the air/fuel ratio. If the frequency is too low, a significant pulsation of the fuel flow will occur and will not decay out within the induction passage 16 so that there may occur hunting in the operation of the engine 10. From a practical viewpoint, however, the frequency cannot be increased as one wishes because of restriction by the responsiveness and/or durability of the electromagnetic valve 26 attributable mainly to a practical limit to the mass of the armature. In a system according to the invention, the frequency of the pulses for the operation of the electromagnetic valve 26 is in the range between 5 and 100 Hz and is preferably kept constant.

The proportion of the air feed rate through the auxiliary air passage 24 to the air feed rate through the main air bleed passage 42 is an important factor in the control of the air/fuel ratio according to the invention and has a significant influence on the range of realizable air/fuel ratios.

In a system according to the invention, the air/fuel ratio is controlled by the on-off functions of the electromagnetic valve 26. The carburetor 14 is preliminarily adjusted to produce an air/fuel ratio somewhat higher than the stoichiometric ratio when the valve 26 is open and another air/fuel ratio somewhat lower than the stoichiometric ratio when the valve 26 is closed although the system intends to maintain the air/fuel ratio at or close to the stoichiometric ratio. The momentarily deviated air/fuel ratios are converged to an average value, i.e., a predetermined ratio equal or close to the stoichiometric ratio, while the air/fuel mixture flows through the induction passage 16 to the intake ports of the engine 10 because of the adequately determined frequency of the valve functions as described hereinbefore.

In practical operations of the engine 10, there is a possibility of relatively great deviations of the air/fuel ratio from the initially settled value due to changes in the ambient temperature, atmospheric pressure, engine temperature, and/or performance of the carburetor 14 itself during a prolonged use. It is necessary, therefore, to determine the two air/fuel ratios under the open and closed valve conditions such that the difference therebetween is large enough to correct even a maximumly deviated air/fuel ratio in a short time. To describe numerically, the highest air/flow ratio which is produced by opening the electromagnetic valve 26 is settled preferably at about 17 with respect to the stoichiometric ratio of about 14.8 and the lowest air/fuel ratio with the valve 26 closed at about 12. Thus, the air feed rate through the main air bleed 46 is just enough to correct the fundamental air feed rate through the venturi 70 of the induction passage 16 to maintain the air/fuel ratio at about 12 when the auxiliary air passage 24 is closed. The means that the absolute value of the air feed rate through the main air bleed 46 is very small. If, therefore, the proportion of the air feed rate through the auxiliary air passage 24 is less than the air feed rate through the main air bleed 46, the controlling capacity of a system according to the invention is not large enough to correspond to the aforementioned great deviation of the actual air/fuel ratio from the predetermined value.

In the present invention, the air feed rate through the auxiliary air passage 24 (when the valve 26 is open) is at least the same as and preferably greater than the air feed rate through the main air bleed 46. Accordingly, the auxiliary air passage 24 is provided with the metering orifice 48 the area of which is at least the same as the area of the metering orifice 46 of the main air bleed passage 42 and about five times as large as the latter area at the maximum. The similar relationship is applicable to the combination of the auxiliary air passage 52 and the air bleed passage 54 for the slow-speed fuel discharge passage 50.

The opening 74 of the auxiliary air admitting passage 24 in the main well 40 should be located above the fuel level (indicated at L in FIG. 5) in the main well 40 when the engine 10 is at rest whether the auxiliary air admitting passage 24 opens into the perforated tube 44 or into a space around the tube 44. If the opening 74 is located below the fuel level L, the fuel will flow into the auxiliary air passage 24 when the other end of air passage 24 is kept closed by the valve 26. The presence of fuel in the auxiliary air passage 24 causes a temporary increase in the fuel discharge rate from the main nozzle 38 when the opening 74 of the auxiliary air passage 24 is exposed to the atmosphere to increase the air feed rate. This phenomenon leads to inaccuracy in the air/fuel ratio control and slowness in the response of the auxiliary air passage 24 to the function of the valve 26.

Besides, the auxiliary air passage 24 has another useful function of preventing percolation of fuel when the opening 74 is located above the fuel level L. When the engine 10 is brought into either idling or rest at an elevated engine temperature with provision of the thus arranged auxiliary air passage 24, there is less chance of unwanted fuel discharge from the main nozzle 38 because air in the main well 40 can be expelled into the auxiliary air passage 24 in addition to the usual discharge through the main air bleed 46.

The same arrangement is applicable to the auxiliary air passage 52 for the idling circuit.

There remains a little possibility of fuel flowing into the auxiliary air passage 24 even though the opening 74 is located above the fuel level L because a partial vacuum is liable to be produced temporarily in the auxiliary air passage 24 due to pulsation of air therein resulting from on-and-off functions of the electromagnetic valve 26. Also evaporation of fuel results in admission of fuel into the air passage 24. The inflow of a fuel into the auxiliary air passage 24 does not offer a practically significant problem if the inflowed fuel returns to the main well 40 rapidly. Since the auxiliary air passage 24 is usually formed over a considerably long distance for reasons mainly attributable to limitations to the disposition of the electromagnetic valve 26, it is important to arrange the auxiliary air passage 24 so as not to allow the inflowed fuel to remain therein. The quantity of the thus inflowed fuel is not so large as to offer a practical problem when the electromagnetic valve 26 is repeatedly functioned at short intervals, but the quantity reaches a significant level when the valve is left at rest for a relatively long period of time.

Figure 5:
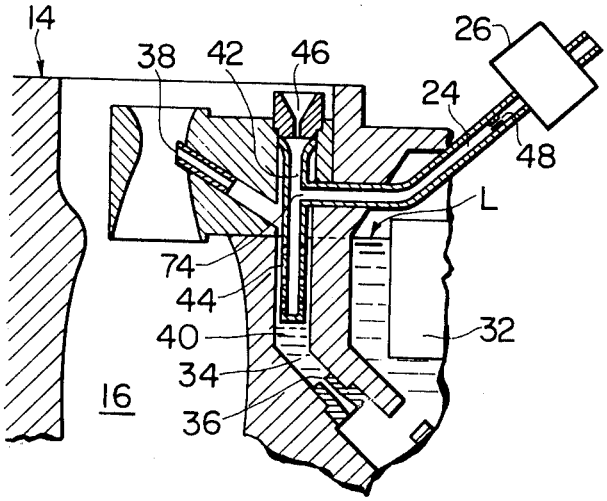
FIG. 5 is a fragmentary sectional view of the carburetor of FIG. 2, showing the arrangement of the auxiliary air admitting passage in a system according to the invention.

To cause outflow of the drawn or evaporated fuel, the auxiliary air passage 24 is preferably arranged such that the opening 74 in the main well 40 takes the lowest position and the other opening to the atmosphere takes the highest position as shown in FIG. 5. In FIG. 5, part of the auxiliary air passage 24 is arranged generally horizontally and the remaining part is inclined upwards with respect to the horizontal plane or a horizontally arranged part, but the arrangement is not limited to the illustrated one. Referring to sketches of FIG. 6, a major and upstream-side portion of the auxiliary air passage 24 may alternatively be arranged vertically as seen at (A), or stepped to have horizontal and vertical sections as seen at (B). Also an entirely horizontal arrangement as shown at (C) is permissible. If necessary, the auxiliary air passage 24 may be generally inclined downwards with respect to a horizontal plane as shown at (D), so that the opening 74 in the main well 40 takes the highest position and the other opening the lowest. With the arrangement (D), it is necessary to provide a branch passage 76 to return the fuel in the auxiliary air passage 24 to, e.g., the float chamber 32.

Figure 6:
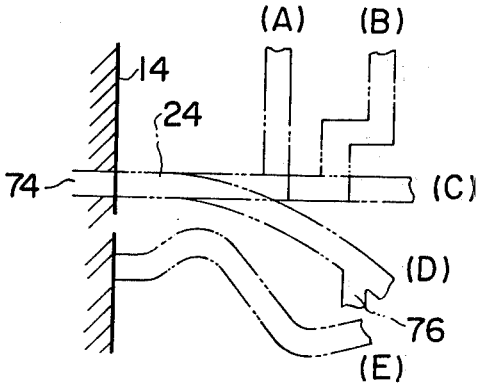
FIG. 6 is a schematic representation of a modified arrangement of the auxiliary air admitting passage of FIG. 5.

To summarize, the auxiliary air passage 24 should not have any inflection point at which its inclination angle with a horizontal plane changes from a positive angle to a negative angle, and vice versa. The arrangement shown at (E) of FIG. 6 is an undesirable example. The same rule applies to the other auxiliary air passage 52 for the slow-speed circuit.

The carburetor 14 of FIG. 1 may be of the two-barrel, two-stage downdraft type as shown in FIG. 7. The induction passage 16 of this carburetor 14A is divided into two sections, a primary section 78 and a secondary section 80, which join together at a section downstream of the respective throttles 82 and 84. The primary section 78 works incessantly at any engine speed, but the secondary section 80 works only when the engine 10 is run at relatively high speeds, for example, to drive a car at vehicle speeds above 80 or 100 km per hour at top gear. Accordingly, the primary section 78 alone works almost throughout a speed range in which the engine 10 is most frequently operated.

In controlling the air/fuel ratio with this carburetor 14A, the control loop according to FIGS. 1, 2 and 4 may be applied to both the primary and secondary sections 78 and 80, but the mechanism of the control loop needs a considerable complication in its practical construction in order to carry out the air/fuel ratio control with respect to the secondary section 80 only when this section 80 is in operation. From a practical viewpoint, there is little necessity to apply the control loop to the secondary section 80 with endurance of a complication in construction. The air/fuel ratio control exclusively with respect to the primary section 78 suffices for practical operation of the engine 10. In FIG. 7, the main fuel passage 34 and the slow-speed fuel passage 50 for the primary section 78 of the induction passage 16 are provided with the auxiliary air admitting passages 24 and 52, respectively, and the communications of these passages 24 and 52 with the atmosphere are controlled in the same manner as in the case of FIG. 2, but the auxiliary air admitting passage 52 may be omitted.

Figure 8:
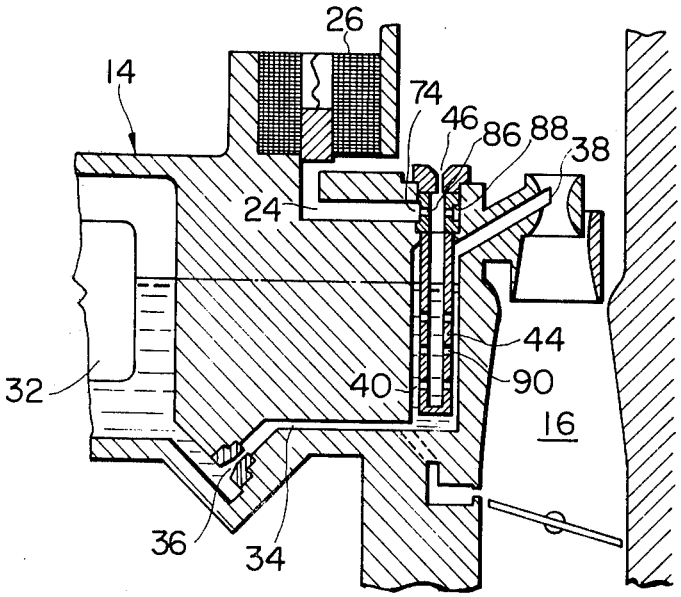
FIG. 8 is a sectional view generally similar to FIG. 5 but shows a slight modification of the auxiliary air admitting passage and an emulsion tube in the carburetor.

The auxiliary air supplied through the auxiliary air passage 24 is preferably admitted into the main well 40 such that the auxiliary air is firstly mixed with the air drawn through the main air bleed 46 and then mixed with the fuel in the main well 40 in order to avoid disturbance of the fuel flow. As shown in FIG. 8, the opening 74 of the auxiliary air passage 24 in the main well 40 preferably takes the form of apertures 86 formed in the wall of a tubular member 88 which is tightly received in an uppermost section of the main well 40 to rest on the upper end of the perforated tube or emulsion tube 44 which delivers air from the air bleed 46 to the fuel. The apertures 90 of the emulsion tube 44 are formed at locations below the fuel level in the emulsion tube 44, but the apertures 86, i.e., the opening 74 of the auxiliary air passage 24, are located above the same fuel level and below the main air bleed 46. In this arrangement, the apertures 86 serve as the metering orifice 48 in FIG. 2 of the auxiliary air admitting passage 24.

Figure 9I:
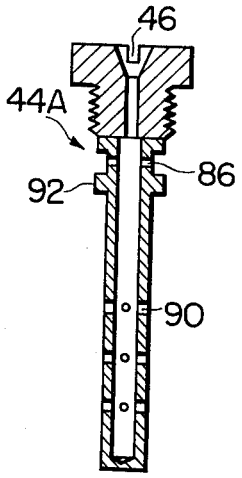
FIG. 9 is an enlarged and sectional view of the emulsion tubes, showing modified arrangements of auxiliary air inlets in FIG. 8.
Figure 9:
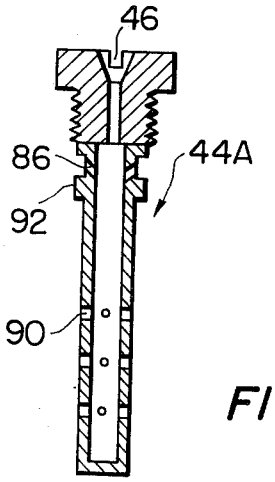
Figure 9:
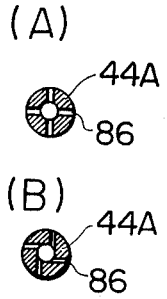

The tubular member 88 having the apertures 86 may be made as part of the emulsion tube 44. In FIG. 9, an emulsion tube 44A has a flange 92 at a short distance from its upper end to tightly fit in with the inner surface of the main well 40, and the apertures 86 are formed in the wall of the tube 44A between the upper end thereof and the flange 92. These apertures 86 may be formed either radially as shown in a cross-sectional view (A) or along optional chords deviated from the radii as shown in another cross-sectional view (B). In elevation, the apertures 86 are formed either perpendicular to the axis of the emulsion tube 44A as seen in the view (I) or somewhat inclined downwards as seen in another view (II).

The auxiliary air passage 52 for the slow-speed fuel passage 50 can be terminated in a perforated tube (not shown) substantially in the same manner as the above description.

Figure 10:
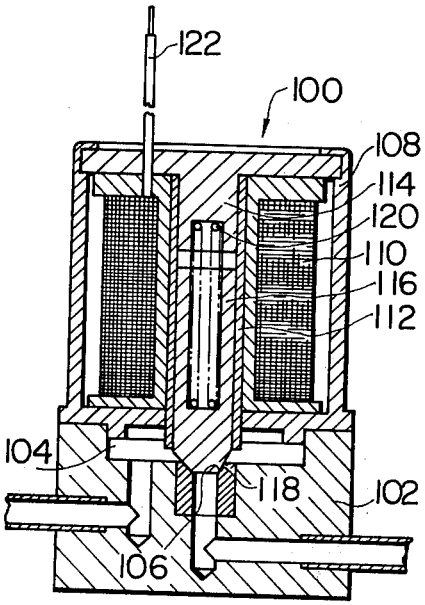
FIG. 10 PRIOR ART
FIG. 10 is a sectional view of a conventional electromagnetic valve for use in the system of FIG. 1.

FIG. 10 shows a conventional solenoid valve 100 which is useful as the electromagnetic valve 26 in a system of FIG. 1. In a block or base 102 of this solenoid valve 100, a fluid conduit 104 is formed with a valve seat 106 formed in a middle section. In a housing 108 mounted on the block 102, a coil 110 is stationarily disposed to surround a tubular guide member 112. The guide member 112 receives in its upper section a stationary iron core 114 and a slidable iron core or a plunger 116 in the remaining section. The lower end 118 of the plunger 116 is shaped to function as the valve member and normally engages with the valve seat 106, so that the conduit 104 is kept closed. The upper end of the plunger 116 is spaced from the bottom of the stationary iron core 114, and a compression spring 120 is arranged in the guide member 112 to keep the plunger 116 in this position. Leads for passing a current through the coil 110 are represented at 122, and the housing 108 provides a shunt path for the flux.

The operation of this valve 100 will need no explanation. Since the valve 100 is subjected to very frequent repetition of on-off operations in a system according to the invention, the durability of the valve seat 106 and the valve member 118 is a critical factor in the practicability of this valve 100. When this valve 100 is used for the control of a gas flow, however, the valve seat 106 and the valve member 118 are not sufficiently durable due to wear by friction and temperature rise. Besides, there is a dissatisfaction with the responsiveness of the valve member 118 to the current application originated from a relatively large mass and, hence, a large inertia of the plunger 116.

These shortcomings of the conventional solenoid valve 100 can be remedied by an improved electromagnetic valve as described hereinafter with reference to FIGS. 11 and 12.

In an improved electromagnetic valve according to the invention, a movable valve member which is at least partly made of a magnetic material is arranged in a chamber formed as part of the fluid conduit. The valve member is supported and allowed to move along a fixed axis by either a single or a plurality of flexible support members instead of a rigid guide member 112 in the conventional solenoid valve 100 in which the valve member 118, i.e., plunger 116 is received slidably. The valve member is moved relatively to the valve seat when a stationary core is excited. Non-magnetic metals such as phosphor bronze and gunmetal, rubber, synthetic resin and fabrics are useful as the material of the support member in the form of a diaphragm, wire or sheet.

Figure 11:
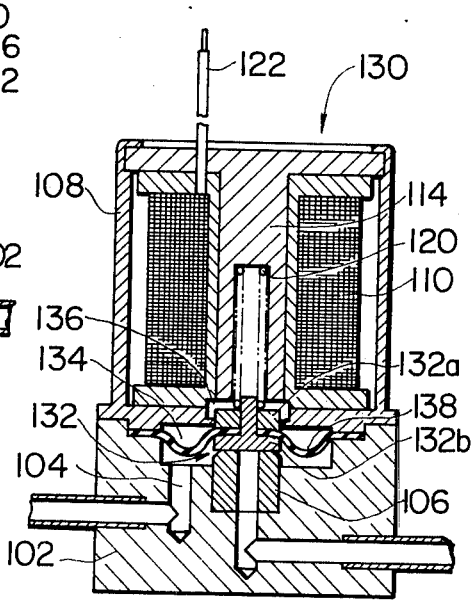
FIG. 11 is a similar view of an improved electromagnetic valve for the same use.
Figure 13:
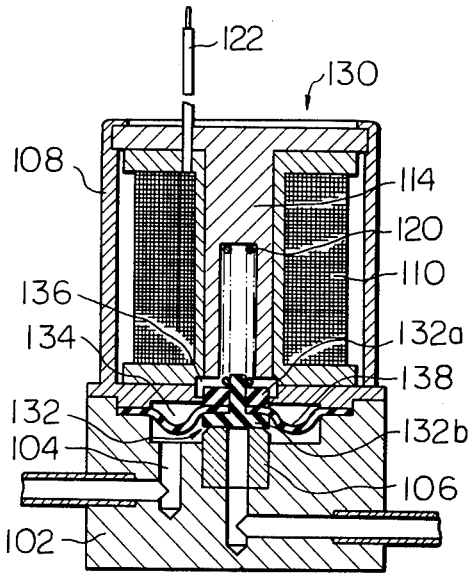
FIG. 13 is a sectional view of a variant of the electromagnetic valve in FIG. 11.

In an electromagnetic valve 130 of FIG. 11, a valve member 132 is considerably smaller in size than the plunger 116 of the valve 100 of FIG. 10. This valve 130 includes no guide member to receive therein the valve member 132, and the valve member 132 is disposed in a chamber 134 formed in the conduit 104 around the valve seat 106. The bottom of the housing 108 has a relatively large hole 136 to allow the valve member 132 to move upwards without sliding along any surface of the housing 108. The stationary iron core 114 is extended downwards to fill almost the entire space in the coil 110 and to terminate at a distance from the upper end of the valve member 132. The valve member 132 is kept at this position by the compression spring 120. Either entirely or partly, the valve member 132 is made of a material having a relatively high permeability such as, e.g., iron as shown in FIG. 11 or rubber containing iron powder dispersed therein as shown in FIG. 13. In FIG. 11, the valve member 132 is divided into two parts, namely, an annular part **132*a* and a sectionally T-shaped part 132*b*. These two parts 132*a* and 132*b* are assembled together airtightly as illustrated so that the wider end face of the latter part 132*b* faces the valve seat 106 while the narrower end face faces the lower end face of the stationary core 114. To minimize the mass of the valve member 132, either of the two parts 132*a* and 132*b* is preferably made of a light metal, rubber or a synthetic resin. From the viewpoint of durability of the valve member 132, it is preferable to use rubber or an elastomeric synthetic resin as the material of the lower part 132*b* which comes into contact with the valve seat 106. Alternatively, the valve member 132** may consists of two cylindrical parts (not shown) which are placed one upon another.

The valve member 132 is supported by a flexible diaphragm 138 which is fixed to the block 102 and/or the housing 108. The valve seat 106 and the lower end face of the valve member 132 may be shaped conical as in the case of the valve 100 in FIG. 10, but preferably shaped flat as shown in FIG. 11. In other respects, the improved electromagnetic valve 130 is constructed similarly to the conventional valve 100.

When an exciting current is passed through the coil 110, the valve member 132 is attracted by the excited core 114 and is pulled upwards despite its position unsurrounded by the coil 110. When the current is cut, the valve member 132 is pushed against the valve seat 106 by the spring 120. In this case, the diaphragm 138 assists the valve member 132 in moving along a constant axis and being accurately seated on the valve seat 106.

The improved electromagnetic valve 130 has the following advantages: (1) the valve member 132 suffers from no wear by friction due to exclusion of sliding movement; (2) the responsiveness is improved due to reduction in the mass of the movable valve member 132; (3) the durability of the valve seat 106 and the valve member 132 is enhanced because of the reduced mass of the valve member 132 and reduction in the contact pressure attributable to the flat contact faces of the valve member 132 and the valve seat 106.

The diaphragm 138 is provided for the purpose of moving the valve member 132 in an accurate direction with respect to the valve seat 106, but may be designed also to have a restoring force large enouth to assist the downward movement of the valve member 132. To facilitate the core 114 to attract the valve member 132, the diaphragm 138 may be perforated locally.

Figure 12:
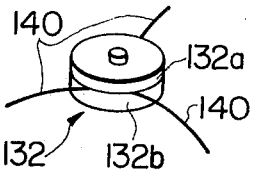
FIG. 12 is a perspective view of the valve member of the electromagnetic valve of FIG. 11, showing a modification of the support member for the valve member

As described hereinbefore and shown in FIG. 12, the diaphragm 138 for supporting the valve member 132 can be replaced by a few pieces of wires 140 each of which extends laterally of the valve member 132 at an angle with each other and is fixed at its one end to the valve member 132 and at the other end to the block 102 and/or the housing 108. The number of the wires 140 can be varied depending on the characteristics of the valve 130. The valve member 132 is not necessarily divided into two parts so long as the diaphragm 138 or the wires 140 can be secured to the valve member 132.

An electromagnetic valve which is based on the thus constructed and arranged valve member 132 and the support member 138 or 140 but functions to interrupt the flow of air through the conduit 104 when a current is applied to the coil 110 can be obtained by using a permanent magnet as the material of the valve member 132. Alternatively, the valve member 132, valve seat 106 and the conduit 104 are arranged such that the valve member 132 is remotest from the core 114 and seated on the valve seat 106 when attracted upwards by the core 114.

What is claimed is:

1. In an internal combustion engine provided with a carburetor having an air bleed passage opening into a fuel discharge passage and an exhaust system having a catalytic converter containing therein a catalyst which catalyzes both the reduction of oxides of nitrogen and the oxidation of carbon monoxide and hydrocarbons, a system for promoting the catalytic conversion reactions in the catalytic converter, comprising:

means for defining an auxiliary air admitting passage connected to the fuel discharge passage of the carburetor;

means for sensing the concentration of a particular component of the exhaust gas in the exhaust system at a section upstream of the catalytic converter and for producing an electrical signal representing the sensed concentration, said concentration being in dependence on the air/fuel ratio of an air/fuel mixture fed to the engine;

a control circuit having means for continuously producing electrical pulses at a frequency between 5 and 100 Hz, the width of said pulses varying individually in dependence upon said air/fuel ratio such that said width increases when said air/fuel ratio indicated by said electrical signal is below a predetermined ratio which equals at least approximately to a stoichiometric air/fuel ratio and decreases when said air/fuel ratio is above said predetermined ratio; and an electromagnetic valve receptive of said pulses and effective to allow admission of auxiliary air to said auxiliary air admitting passage only when each of said pulses is applied thereto, so that the fuel discharge rate to the induction passage of the carburetor is varied in response to deviations of said air/fuel ratio from said predetermined ratio.

2. A system as claimed in claim 1, wherein the sensing means is an oxygen sensor of the concentration cell type having an ion-conducting solid electrolyte as a sensing element.

3. A system as claimed in claim 2, wherein said control circuit includes: means for comparing an output voltage of said oxygen sensor with a predetermined reference voltage; means for producing a control signal in dependence on the difference between said output voltage of said oxygen sensor and said reference voltage, said control signal having a component proportional to said difference and another component representing the integral of said difference; means for generating a continual triangular wave at a frequency between 5 and 100 Hz; and means for generating a series of pulses at said frequency, the width of said pulses varying individually in response to said control signal such that said width increases gradually while said output voltage is higher than said reference voltage and decreases gradually while said output voltage is lower than said reference voltage.

4. A system as claimed in claim 3, wherein said frequency is constant.

5. A system as claimed in claim 3, wherein said electromagnetic valve comprises: a stationary iron core; a base member forming therethrough a fluid passage; a stationary valve seat exposed to said fluid passage; a movable valve member arranged in said fluid passage such that said valve member is located at a distance from an end of said iron core when said iron core is not excited, at least a portion of said valve member being made of a material having a relatively high permeability, and at least one flexible support member fixed to and extending from said valve member such that said valve member is attracted by said iron core and moves towards said end of said iron core when an exciting current is applied to said electromagnetic valve and returns to the initial location along a constant axis when said electromagnetic valve is deenergized, said valve seat being arranged such that said valve member is seated thereon to interrupt fluid communication through said fluid passage when said iron core is in one of the excited and unexcited states.

6. A system as claimed in claim 5, wherein said valve seat is arranged such that said valve member is seated thereon when said iron core is unexcited.

7. A system as claimed in claim 6, wherein an end face of said valve member opposite said valve seat is shaped flat.

8. A system as claimed in claim 7, wherein said at least one flexible member is a flexible diaphragm arranged generally vertically to said axis.

9. A system as claimed in claim 7, wherein said at least one flexible member is a plurality of wires each extending from said valve member generally vertically to said axis at an angle with the other wires.

10. A system as claimed in claim 7, wherein a portion of said valve member forming said end face is made of rubber.

11. A system as claimed in claim 7, wherein a portion of said valve member forming said end face is made of an elastomeric synthetic resin.

12. A system as claimed in claim 6, wherein said material is rubber containing iron powder dispersed therein.

13. A system as claimed in claim 1, wherein an intermediate section of the fuel discharge passage forms a well, said auxiliary air admitting passage opening into said well above and close to the fuel level in said well when the engine is at rest.

14. A system as claimed in claim 13, wherein the cross-sectional area of said auxiliary air admitting passage at the narrowest section is one to five times as large as the cross-sectional area of said air bleed passage at the narrowest section.

15. A system as claimed in claim 13, wherein said auxiliary air admitting passage is arranged such that the inclination angle of said auxiliary air admitting passage in any portion thereof with a horizontal plane is of the same one of positive and negative signs both inclusive of zero.

16. A system as claimed in claim 15, wherein said inclination angle with said horizontal plane is a positive angle between 0° and 90°.

17. A system as claimed in claim 13, wherein the carburetor has a slow-speed fuel discharge passage and another air bleed passage opening into the slow-speed fuel discharge passage, the system further comprising means defining another auxiliary air admitting passage connected to the slow-speed fuel discharge passage of the carburetor, and another electromagnetic valve arranged to receive said pulses and effective to allow admission of auxiliary air to said another auxiliary air admitting passage only when each of said pulses is applied thereto.

18. A system as claimed in claim 17, wherein said another auxiliary air admitting passage opens into the air bleed passage for the slow-speed fuel discharge passage at an intermediate section downstream of an air bleed orifice for the slow-speed fuel discharge passage and above the fuel level in the slow-speed fuel discharge passage when the engine is at rest.

19. A system as claimed in claim 13, wherein the carburetor has a slow-speed fuel discharge passage and another air bleed passage opening into tht slow-speed fuel discharge passage, the system further comprising another auxiliary air admitting passage connected to the slow-speed fuel discharge passage of the carburetor, said another air admitting passage joining the former auxiliary air admitting passage at a section upstream of metering orifices of the two auxiliary air admitting passages, said electromagnetic valve being arranged to control admission of air into the two auxiliary air admitting passages at a section upstream of the joining section.

20. A system as claimed in claim 19, wherein said another auxiliary air admitting passage opens into the air bleed passage for the slow-speed fuel discharge passage at an intermediate section downstream of an air bleed orifice for the slow-speed fuel discharge passage and above the fuel level in the slow-speed fuel discharge passage when the engine is at rest.

21. A system as claimed in claim 13, wherein the carburetor has a primary induction passage and a secondary induction passage for supplying an additional air/fuel mixture to the engine at relatively high engine speeds, said auxiliary air admitting passage being arranged to control exclusively the air feed rate to the fuel discharge passage for said primary induction passage.

22. A system as claimed in claim 21, wherein the carburetor has a slow-speed fuel discharge passage opening into said primary induction passage and another air bleed passage opening into said slow-speed fuel discharge passage, the system further comprising another auxiliary air admitting passage arranged to control the air feed rate to said slow-speed fuel discharge passage.

23. A system as claimed in claim 13, wherein the air bleed passage opens into said well, said auxiliary air admitting passage being arranged independently of and in parallel relation to the air bleed passage.

24. A system as claimed in claim 13, wherein said auxiliary air admitting passage joins the air bleed passage at a section between a metering orifice of the air bleed passage and said fuel level.

25. A system as claimed in claim 24, wherein the carburetor includes a perforated tube partly immersed into the fuel in said well, the interior of said tube serving as a major and lower portion of the air bleed passage, said auxiliary air admitting passage opening into said interior of said tube through at least one hole formed in the peripheral wall thereof at a section between said fuel level and said air bleed orifice.

26. A system as claimed in claim 25, wherein said at least one hole has such an area that said at least one hole serves as the metering orifice of said auxiliary air admitting passage.

27. In an internal combustion engine provided with a carburetor having an air bleed passage opening into a fuel discharge passage and an exhaust system having a catalytic converter containing therein a catalyst which catalyzes both the reduction of oxides of nitrogen and the oxidation of carbon monoxide and hydrocarbons, a system for promoting the catalytic conversion reactions in the catalytic converter comprising:

means for defining an auxiliary air admitting passage connected to the fuel discharge passage of the carburetor;

sensing means for sensing the concentration of a particular component of the exhaust gas in the exhaust system at a section upstream of the catalytic converter and for producing an electrical signal representing the concentration of said component sensed, said concentration depending upon the air/fuel ratio of an air/fuel mixture fed to the engine;

a control circuit having means for continuously producing electrical pulses at a frequency between 5 and 100 Hz, the ratio of the duration of each pulse to the time interval between said each pulse and a next sequential pulse varying or dependance upon a magnitude of a deviation of said air/fuel ratio, corresponding to said electrical signal, from a predetermined ratio which equals at least to a stoichiometric air/fuel ratio;

and an electromagnetic valve receptive of said pulses and effective to allow admission of auxiliary air to said auxiliary air admitting passage only when each of said pulses is applied thereto, so that the fuel discharge rate to the induction passage of the carburetor varies in response to deviations of said air/fuel ratio from said predetermined ratio.

28. A system as claimed in claim 27, wherein an intermediate section of the fuel discharge passage defines a well, said auxiliary air admitting passage opening into said well above and close to the fuel level in said well when the engine is at rest, the air bleed passage and said auxiliary air admitting passage individually having a metering orifice, the cross-sectional area of the metering orifice of said auxiliary air admitting passage being not smaller than cross-sectional area of the air bleed passage.

29. In an internal combustion engine provided with a carburetor of the fixed venturi type having an air bleed passage opening into a fuel discharge passage and an exhaust system having a catalytic converter containing therein a catalyst which catalyzes both the reduction of oxides of nitrogen and the oxidation of carbon monoxide and hydrocarbons, a system for promoting the catalytic conversion reactions in the catalytic converter comprising:

means for defining an auxiliary air admitting passage connected to the fuel discharge passage of the carburetor;

sensing means for sensing the concentration of a particular component of the exhaust gas in the exhaust system at a section upstream of the catalytic converter and for producing an electrical signal representing the concentration sensed, said concentration depending upon the air/fuel ratio of an air/fuel mixture fed to the engine; a control circuit having means for continuously producing electrical pulses at a frequency between 5 and 100 Hz, the ratio of the duration of each pulse to the time interval between said each pulse and a next sequential pulse varying in dependance upon a magnitude of a deviation of said air/fuel ratio, corresponding to said electrical signal, from a predetermined ratio which equals at least to a stoichiometric air/fuel ratio;

and an electromagnetic valve receptive of said pulses and effective to allow admission of auxiliary air to said auxiliary air admitting passage only when each of said pulses is applied thereto, so that the fuel discharge rate to the induction passage of the carburetor varies in response to deviations of said air/fuel ratio from said predetermined ratio.

30. A system as claimed in claim 29, wherein an intermediate section of the fuel discharge passage defines a well, said auxiliary air admitting passage opening into said well above and close to the fuel level in said well when the engine is at rest, the air bleed passage and said auxiliary air admitting passage individually having a metering orifice, the cross-sectional area of the metering orifice of said auxiliary air admitting passage being not smaller than cross-sectional area of the air bleed passage.

31. A system as claimed in claim 30, wherein the carburetor has a slow-speed fuel discharge passage and another air bleed passage opening into the slow-speed fuel discharge passage, the system further comprising means defining another auxiliary air admitting passage connected to the slow-speed fuel discharge passage of the carburetor, and another electromagnetic valve arranged to receive said pulses and effective to allow admission of auxiliary air to said another auxiliary air admitting passage only when each of said pulses is applied thereto.

32. A system as claimed in claim 30, wherein the carburetor has a slow-speed fuel discharge passage and another air bleed passage opening into the slow-speed fuel discharge passage, the system further comprising another auxiliary air admitting passage connected to the slow-speed fuel discharge passage of the carburetor, said another air admitting passage joining the former auxiliary air admitting passage at a section upstream of metering orifices of the two auxiliary air admitting passages, said electromagnetic valve being arranged to control admission of air into the two auxiliary air admitting passages at a section upstream of the joining section.

* * * * *